US010533260B2

(12) United States Patent
Goto et al.

(10) Patent No.: US 10,533,260 B2
(45) Date of Patent: Jan. 14, 2020

(54) SN PLATING STEEL SHEET, CHEMICAL TREATMENT STEEL SHEET, AND METHOD OF MANUFACTURING THE SAME

(71) Applicant: NIPPON STEEL & SUMITOMO METAL CORPORATION, Tokyo (JP)

(72) Inventors: Yasuto Goto, Kimitsu (JP); Takashi Futaba, Himeji (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/538,421

(22) PCT Filed: Feb. 8, 2016

(86) PCT No.: PCT/JP2016/053651
§ 371 (c)(1),
(2) Date: Jun. 21, 2017

(87) PCT Pub. No.: WO2016/125911
PCT Pub. Date: Aug. 11, 2016

(65) Prior Publication Data

US 2017/0342585 A1 Nov. 30, 2017

(30) Foreign Application Priority Data

Feb. 6, 2015 (JP) ..... 2015-022385

(51) Int. Cl.
*B23B 15/00* (2006.01)
*C25D 9/10* (2006.01)
*C25D 3/32* (2006.01)

(52) U.S. Cl.
CPC ..... *C25D 9/10* (2013.01); *C25D 3/32* (2013.01)

(58) Field of Classification Search
None
See application file for complete search history.

(56) References Cited

U.S. PATENT DOCUMENTS 4,388,158 A * 6/1983 Inui ..... C25D 3/30 205/154
4,861,441 A 8/1989 Saito et al.
(Continued)

FOREIGN PATENT DOCUMENTS

CN 102089463 A 6/2011
CN 101652503 B 7/2012
(Continued)

OTHER PUBLICATIONS

Asano et al., "Effect of Tin Crystal Orientation on the Corrosion of Tin Plate", Iron and Steel, 1969, No. 2, pp. 184-189.
(Continued)

*Primary Examiner* — Seth Dumbris
(74) *Attorney, Agent, or Firm* — Birch, Stewart, Kolasch & Birch, LLP

(57) ABSTRACT

The chemical treatment steel sheet includes a steel sheet, a mat finished Sn plating layer that is provided as an upper layer of the steel sheet and is formed of a β-Sn, and a chemical treatment layer that is provided as an upper layer of the Sn plating layer. The Sn plating layer contains the β-Sn of 0.10 g/m$^2$ to 20.0 g/m$^2$ in terms of an amount of metal Sn. A crystal orientation index of a (100) plane group of the Sn plating layer is higher than crystal orientation indexes of other crystal orientation planes. The chemical treatment layer includes a Zr compound containing Zr of 0.50 mg/m$^2$ to 50.0 mg/m$^2$ in terms of an amount of metal Zr, and a phosphate compound.

5 Claims, 2 Drawing Sheets

(56) References Cited

U.S. PATENT DOCUMENTS

| | | | | |
|---|---|---|---|---|
| 5,871,631 | A | 2/1999 | Ichiba et al. | |
| 2003/0226758 | A1* | 12/2003 | Egli | C25D 3/30 205/252 |
| 2011/0180185 | A1 | 7/2011 | Suzuki et al. | |
| 2013/0209830 | A1 | 8/2013 | Suzuki et al. | |

FOREIGN PATENT DOCUMENTS

| | | | | | |
|---|---|---|---|---|---|
| DE | 3784416 | T2 | | 9/1993 | |
| EP | 2 143 822 | A1 | | 1/2010 | |
| EP | 2589685 | A1 | | 5/2013 | |
| EP | 2 738 111 | A1 | | 6/2014 | |
| JP | 60-155695 | A | | 8/1985 | |
| JP | 9-209188 | A | | 8/1997 | |
| JP | 2001-098396 | A | | 4/2001 | |
| JP | 2005-23422 | A | | 1/2005 | |
| JP | 2006-9047 | A | | 1/2006 | |
| JP | 2006-70340 | A | | 3/2006 | |
| JP | 2009-84623 | A | | 4/2009 | |
| JP | 2009-209383 | A | | 9/2009 | |
| JP | 2010-013728 | | * | 1/2010 | C23C 28/00 |
| JP | 2010-13728 | A | | 1/2010 | |
| JP | 2011-74458 | A | | 4/2011 | |
| WO | WO 2010/090204 | A1 | | 8/2010 | |

OTHER PUBLICATIONS

International Search Report for PCT/JP2016/053651 dated Apr. 12, 2016.

Notice of Allowance issued in TW 105104282 dated Sep. 30, 2016.

Written Opinion of the International Searching Authority for PCT/JP2016/053651 (PCT/ISA/237) dated Apr. 12, 2016.

Extended European Search Report, dated Sep. 14, 2018, for corresponding European Application No. 16746740.6.

Wikipedia, "International System of Units," https://en.wikipedia.org/wiki/International_System_of_Units, downloaded from the Internet on Oct. 18, 2018, pp. 1-20.

European Search Report dated Jul. 17, 2018 issued in European Patent Application 16746740.6.

JIS G3303:2008; Tin plate and tin plate; 2008.

Office Action—Request for Correction for counterpart Japanese Application No. 2016-540711, dated Mar. 29, 2019, with English translation.

Tohru Watanabe, Crystal Structure Analysis Method of Plating Film, Surface Technology, vol. 40, No. 2, Issued Feb. 1, 1989, pp. 280-286, with partial translation.

Indian Office Action for counterpart Indian Application No. 201717020480, dated Feb. 27, 2019, with English translation.

Japanese Appeal Decision dated Jun. 10, 2019, issued in Japanese Patent Application No. 2016-540711, with English translation.

Koichiro Inoue et al, Surface Morphology and Crystallographic Orientation of Electrodeposited Fe Film, J. Japan Inst. Metals, vol. 65, No. 4 (2001), The Japan Institute of Metals and Materials, pp. 229-235, with partial English translation.

Koichiro Inoue et al, Surface Morphology and Crystallographic Orientation of Electrodeposited Gold Films, J. Japan Inst. Metals, vol. 66, No. 4 (2002), The Japan Institute of Metals and Materials, pp. 400-408, with partial English translation.

The Surface Finishing Society of Japan, Summary of 76th Congress (1987), pp. 200 to 201 of Summary, with English translation.

* cited by examiner

SN PLATING STEEL SHEET, CHEMICAL TREATMENT STEEL SHEET, AND METHOD OF MANUFACTURING THE SAME

TECHNICAL FIELD OF THE INVENTION

The present invention relates to a Sn plating steel sheet, a chemical treatment steel sheet, and a method of manufacturing the same.

Priority is claimed on Japanese Patent Application No. 2015-22385, filed on Feb. 6, 2015, the content of which is incorporated herein by reference.

RELATED ART

In a steel sheet product, in order to ensure properties such as corrosion resistance, rust resistance, and coating adhesion, there are cases where a chromate treatment is performed on a steel sheet or a surface of a plating steel sheet, on which Sn, Zn, Ni, or the like is plated, to form a chromate film made of chromium oxide or metal Cr and chromium oxide. The chromate film is formed by performing cathode electrolytic treatment (electrolytic chromic acid treatment) using treatment liquid including hexavalent chromium in a solution, with respect to the steel sheet or the plating steel sheet. Incidentally, in recent years, since the hexavalent chromium is hazardous to the environment, there has been a move to replace the chromate treatment with alternative surface treatment.

As a type of the alternative surface treatment, there is known surface treatment performed with a chemical treatment agent containing a Zr compound. For example, Patent Document 1 discloses that chemical treatment reaction is caused by cathode electrolytic treatment using a chemical treatment agent including a Zr compound and an F compound, thereby forming a Zr containing chemical treatment film on a surface of a metal substrate. In addition, Patent Document 2 discloses a metallic material which surface treatment is performed on a surface thereon such as an inorganic surface treatment layer having Zr, O, and F as main components and not having phosphate ion, and an organic surface treatment layer having organic components as main components are formed. In addition, Patent Document 3 discloses that cathode electrolytic treatment is continuously performed on a steel strip in treatment liquid including Zr fluoride ion and phosphate ion, thereby coating the steel strip with a chemical treatment film.

In addition, there is a known technology that a crystal orientation of Sn plating is arranged to a particular plane. For example, in Patent Document 4, for the countermeasures of whisker, crystal orientation of a Sn plating film is preferentially arranged to a (220) plane. In Patent Document 4, film stress after forming the Sn plating film is −7.2 MPa to 0 MPa. In Patent Document 5, a crystal orientation of a Sn plating film on copper foil is arranged to a (200) plane such that roughness of the Sn plating film is increased and a slip between a Sn plating steel sheet and a roll is reduced during continuous plating. Moreover, Patent Document 5 discloses that crystal orientation of the Sn plating film is preferentially arranged to the (200) plane, thereby reducing adhesion of Sn to the roll.

Non-Patent Document 1 discloses that a dense plane of Sn has excellent corrosion resistance.

PRIOR ART DOCUMENT

Patent Document

[Patent Document 1] Japanese Unexamined Patent Application, First Publication No. 2005-23422

[Patent Document 2] Japanese Unexamined Patent Application, First Publication No. 2006-9047

[Patent Document 3] Japanese Unexamined Patent Application, First Publication No. 2009-84623

[Patent Document 4] Japanese Unexamined Patent Application, First Publication No. 2006-70340

[Patent Document 5] Japanese Unexamined Patent Application, First Publication No. 2011-74458

Non-Patent Document

[Non-Patent Document 1] ASANO Hidejiro and OYAGI Yashichi: "Effect of Tin Crystal Orientation on the Corrosion of Tin Plate", Tetsu-to-Hagané, 2(1969), pp. 184-189

DISCLOSURE OF THE INVENTION

Problems to be Solved by the Invention

In a case where a Zr containing chemical treatment film is formed on a Sn plating steel sheet, compared to a case where a chromate film is formed on the Sn plating steel sheet, there is a problem in that corrosion resistance deteriorates. For example, when a chemical treatment steel sheet having a Zr containing chemical treatment film formed on a Sn plating steel sheet is transported and preserved for a long term, there is a problem in that Sn oxide is formed and the external appearance becomes discolored into yellow (hereinafter, will be referred to as yellowing).

In addition, there are cases where the Sn plating steel sheet is used for a container having a beverage, food, or the like as the content. In such cases, in a case where the content is food including protein (amino acid), there is a problem in that Sn of the Sn plating steel sheet and S in the protein (amino acid) react to each other and black SnS is formed (hereinafter, will be referred to as sulfide stain).

The present invention has been made in consideration of the foregoing circumstances, and an object thereof is to provide a Sn plating steel sheet and a chemical treatment steel sheet having excellent corrosion resistance, and a method of manufacturing the same.

Means for Solving the Problem

In order to solve the problems and to achieve the object, the present invention employs aspects as follows.

(1) According to an aspect of the present invention, there is provided a chemical treatment steel sheet including a steel sheet, a mat finished Sn plating layer that is provided as an upper layer of the steel sheet and is formed of a β-Sn, and a chemical treatment layer that is provided as an upper layer of the Sn plating layer. The Sn plating layer contains the β-Sn of 0.10 $g/m^2$ to 20.0 $g/m^2$ in terms of an amount of metal Sn. A crystal orientation index of a (100) plane group of the Sn plating layer is higher than crystal orientation indexes of other crystal orientation planes. The chemical treatment layer includes a Zr compound containing Zr of 0.50 $mg/m^2$ to 50.0 $mg/m^2$ in terms of an amount of metal Zr, and a phosphate compound.

(2) In the chemical treatment steel sheet according to (1), when a crystal orientation index of a (200) plane of the Sn plating layer is defined as X which is expressed by the following Expression (1), the X may be equal to or greater than 1.0.

$$X=(A/B)/(C/D) \quad (1)$$

Here,

X: crystal orientation index A: measurement value (unit: cps) of peak intensity of orientation plane to be obtained, B: sum (unit: cps) of measurement values of peak intensity of (200) plane, (101) plane, (211) plane, (301) plane, (112) plane, (400) plane, (321) plane, (420) plane, (411) plane, (312) plane, (501) plane, C: theoretical value (unit: cps) of peak intensity of orientation plane to be obtained by powder X-ray diffraction, D: sum (unit: cps) of theoretical values of peak intensity of (200) plane, (101) plane, (211) plane, (301) plane, (112) plane, (400) plane, (321) plane, (420) plane, (411) plane, (312) plane, (501) plane obtained by powder X-ray diffraction (3) According to another aspect of the present invention, there is provided a method of manufacturing a chemical treatment steel sheet includes: a Sn electroplating process of forming a Sn plating layer containing a β-Sn on a steel sheet by an electroplating, in which a current density is 10% to 50% with respect to a limiting current density; and a chemical treatment process of performing an electrolytic treatment on the steel sheet, on which the Sn plating layer is formed, to form a chemical treatment layer on the Sn plating layer in a chemical treatment bath.

(4) In the method of manufacturing a chemical treatment steel sheet according to (3), in the chemical treatment process, the electrolytic treatment may be performed on the steel sheet on which the Sn plating layer is formed in the chemical treatment bath including Zr ion of 10 ppm to 10,000 ppm, F ion of 10 ppm to 10,000 ppm, phosphate ion of 10 ppm to 3,000 ppm, and nitrate ion of 100 ppm to 30,000 ppm at a temperature of 5° C. to 90° C. under conditions of the current density of 1.0 $A/dm^2$ to 100 $A/dm^2$ and an electrolytic treatment time of 0.2 seconds to 100 seconds.

(5) According to still another aspect of the present invention, there is provided a Sn plating steel sheet including a steel sheet, and a mat finished plating layer that is provided as an upper layer of the steel sheet and is formed of a β-Sn. The Sn-plating layer contains the β-Sn of 0.10 $g/m^2$ to 20.0 $g/m^2$ in terms of an amount of metal Sn. A crystal orientation index of a (100) plane group of the Sn plating layer is higher than crystal orientation indexes of other crystal orientation planes.

(6) According to still another aspect of the present invention, there is provided a method of manufacturing a Sn plating steel sheet including a Sn electroplating process of forming a Sn plating layer containing a β-Sn on a steel sheet by electroplating, wherein a current density is 10% to 50% with respect to a limiting current density.

Effects of the Invention

According to each of the aspects, it is possible to provide a Sn plating steel sheet and a chemical treatment steel sheet having excellent corrosion resistance, and a method of manufacturing the same.

EMBODIMENT OF THE INVENTION

Hereinafter, with reference to the accompanying drawings, a favorable embodiment of the present invention will be described in detail. In the present embodiment, the same reference symbols will be applied to configuration elements having substantially the same functional configuration and overlapping description will be omitted.

[Chemical Treatment Steel Sheet 10]

Figure 1A:
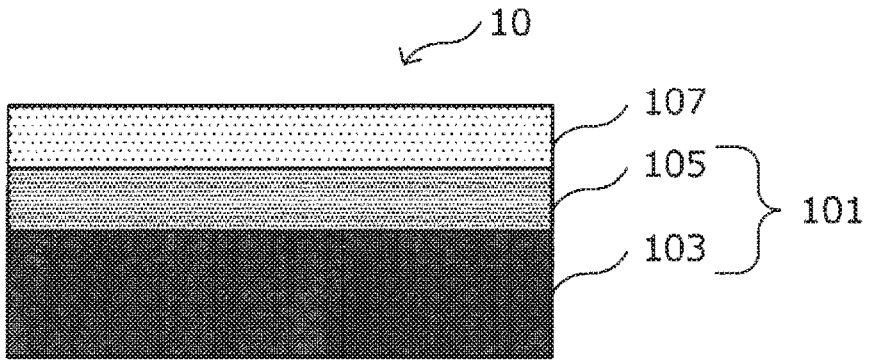
FIG. 1A is a view schematically illustrating a layer structure of a chemical treatment steel sheet according to the present embodiment.
Figure 1B:
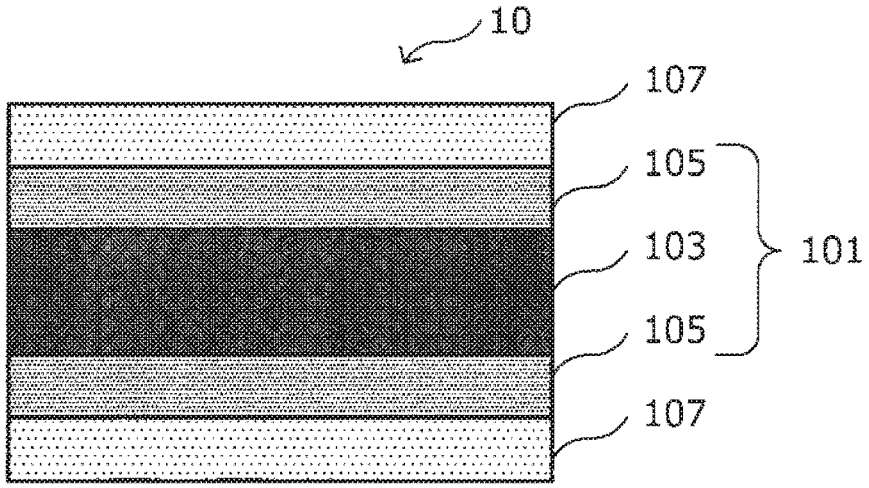
FIG. 1B is a view schematically illustrating another layer structure of the chemical treatment steel sheet according to the present embodiment.

First, with reference to FIGS. 1A and 1B, a chemical treatment steel sheet 10 according to the present embodiment will be described in detail. FIGS. 1A and 1B are views schematically illustrating layer structures in cases where the chemical treatment steel sheet 10 according to the present embodiment is viewed from the side.

As illustrated in FIGS. 1A and 1B, the chemical treatment steel sheet 10 according to the present embodiment includes a Sn plating steel sheet 101 and a chemical treatment layer 107. The Sn plating steel sheet 101 has a steel sheet 103 which is a base metal, and a Sn plating layer 105 which is formed on the steel sheet 103. As illustrated in FIG. 1A, the Sn plating layer 105 and the chemical treatment layer 107 may be formed on only one surface of the steel sheet 103. Otherwise, as illustrated in FIG. 1B, the Sn plating layer 105 and the chemical treatment layer 107 may be formed on two surfaces of the steel sheet 103 opposite to each other.

[Regarding Steel Sheet 103]

The steel sheet 103 is used as the base metal of the chemical treatment steel sheet 10 according to the present embodiment. The steel sheet 103 used in the present embodiment is not particularly limited. Generally, it is possible to use a known steel sheet 103 which is adopted as a material for container. The manufacturing method and the property of the known steel sheet 103 described above are not also particularly limited. It is possible to use a steel sheet 103 which is manufactured through known processes such as hot rolling, pickling, cold rolling, annealing, and temper rolling from a general steel piece manufacturing process.

[Regarding Sn plating Layer 105]

The Sn plating layer 105 is formed on a surface of the steel sheet 103. The Sn plating layer 105 according to the present embodiment is configured of β-Sn having a tetragonal crystal structure. In addition, a surface of the Sn plating layer 105 according to the present embodiment is subjected to mat finishing. The mat finishing is a method of finishing a surface as defined in JIS G3303: 2008, that is, matting treatment of a surface. In a state where a surface of the steel sheet 103 having a dull surface is subjected to Sn plating, hot-dip Sn treatment (reflow treatment) is not performed on the surface and the surface of the Sn plating layer 105 is subjected to the mat finishing.

When the hot-dip Sn treatment is performed with respect to the Sn plating layer 105, surface roughness of the Sn plating layer 105 is reduced. As a result, the Sn plating layer 105 has glossy external appearance and the external appearance defined in JIS G3303: 2008 cannot be obtained. Thus, it is not preferable.

In the present embodiment, the surface of the Sn plating layer 105 is subjected to the mat finishing on the premise. Therefore, the reflow treatment after forming the Sn plating layer 105 is not performed. Therefore, $FeSn_2$ phase and $Ni_3Sn_4$ phase which are alloy layers generated by the reflow treatment do not exist in the chemical treatment steel sheet 10 of the present embodiment in principle.

Hereinafter, with reference to FIG. 1A, an example of the Sn plating layer 105 according to the present embodiment will be specifically described. In the present embodiment, "Sn plating" includes not only plating performed with metal Sn but also includes plating in which unavoidable impurities are mixed into the metal Sn and plating in which very small amount of elements is artificially added to the metal Sn. In the present embodiment, as described below, the Sn plating layer 105 is formed by a Sn electroplating method.

In the Sn plating layer 105 of the present embodiment, the Sn content is 0.10 g/m$^2$ to 20.0 g/m$^2$ per one side surface in terms of metal Sn. If the Sn content is less than 0.10 g/m$^2$ in terms of metal Sn, the thickness of the Sn plating layer 105 becomes thin and the steel sheet 103 cannot be completely coated with the Sn plating layer 105. Accordingly, pinholes are generated. Since Sn is metal rarer than Fe, if pinholes are present, perforation corrosion is likely to occur when being exposed to a corrosive environment. Thus, it is not preferable.

Meanwhile, in a case where the Sn content exceeds 20.0 g/m$^2$, and in a case where the Sn plating layer 105 is preferentially arranged to a (100) plane group by a method described below, a crystal orientation index of the (100) plane group is saturated. Thus, it is not preferable. In addition, in a case where the Sn content exceeds 20.0 g/m$^2$, the effect of corrosion resistance is saturated. Thus, it is not economically preferable. Moreover, in a case where the Sn content exceeds 20.0 g/m$^2$, Sn electroplating treatment for forming the Sn plating layer 105 requires more electric quantity and longer treatment time, and the productivity becomes low. Thus, it is not preferable.

In addition, in the Sn plating layer 105 of the present embodiment, the Sn content per one side surface is preferably 1.0 g/m$^2$ to 15.0 g/m$^2$ in terms of the amount of metal and is more preferably 2.5 g/m$^2$ to 10.0 g/m$^2$. The reason is as follows: (i) when the Sn content is little in terms of metal Sn, influence of the orientation of the steel sheet 103 which is the base metal becomes significant, and it is difficult to obtain a favorable effect by controlling the orientation of the β-Sn in the Sn plating layer 105; and (ii) when the Sn content of the Sn plating layer 105 is significant, the productivity deteriorates. Thus, it is not preferable.

For example, the amount of metal Sn included in the Sn plating layer 105 can be measured by a fluorescent X-ray method. In this case, regarding the amount of metal Sn, a calibration curve related to the amount of metal Sn is particularized in advance by using a known sample of the Sn content, and the amount of metal Sn is relatively particularized by using the same calibration curve. The metal Sn included in the Sn plating layer 105 of the present invention is the β-Sn.

For example, the coverage of the Sn plating layer 105 with respect to the steel sheet 103 can be evaluated by the following method. Examples of a method of quantitatively evaluating the coverage of the β-Sn (exposure rate of iron) include measurement of an iron exposure value (IEV). For the IEV, the Sn plating steel sheet 101 is subjected to anodic polarization to electric potential (1.2 V vs. SCE) in which Sn is passivated, in a test solution which contains sodium carbonate of 21 g/L, sodium hydrogen carbonate of 17 g/L, and sodium chloride of 0.3 g/L, of which pH is 10, and in which the temperature is 25° C.; and current density after the elapse of three minutes is measured. An obtained value of the current density is the IEV. A smaller value of the IEV indicates that the coverage is favorable. In the present embodiment, it is preferable that the IEV is equal to or less than 15 mA/dm$^2$.

The chemical treatment steel sheet 10 is desired to have excellent external appearance when being made into a product. In a case where the chemical treatment steel sheet 10 is used as a container for transportation or for long term preservation, there is a problem in that Sn of the chemical treatment steel sheet 10 and oxygen react to each other, Sn oxide is formed, and yellowing occurs in the external appearance of the container.

In addition, there are cases where the chemical treatment steel sheet 10 is used as a container having a beverage, food, or the like as the content. In such cases, in a case where the content is food including protein (amino acid), there is a problem in that Sn of the chemical treatment steel sheet 10 and S in the protein (amino acid) react to each other and black SnS is formed (hereinafter, will be referred to as sulfide stain). In order to prevent the yellowing and sulfide stain described above, the inventors have found that it is effective to make the dense plane of the β-Sn to be preferentially arranged in the Sn plating layer 105.

In the present embodiment, the crystal orientation of the Sn plating layer 105 is preferentially arranged to the (100) plane group. In other words, in the Sn plating layer 105 of the present embodiment, a crystal orientation index X of the (100) plane group is higher than the crystal orientation indexes X of other crystal orientation planes. The β-Sn is a tetragonal crystal, and the densest plane thereof is the (100) plane group. The (100) plane group having a plane equivalent to (100) includes (010), (200), and (020). In the chemical treatment steel sheet 10 of the present embodiment, the (100) plane group of the Sn plating layer 105 is preferentially arranged. Thus, corrosion resistance such as properties with respect to yellowing (hereinafter, will be referred to as yellowing resistance) and properties with respect to sulfide stain (hereinafter, will be referred to as sulfide stain resistance) is improved.

In the present embodiment, the crystal orientation index X of the (100) plane group in the Sn plating layer 105 is higher than those of other crystal orientation planes. Specifically, the crystal orientation index X of the (200) plane of the Sn plating layer 105 is equal to or greater than 1.0 and is preferably equal to or greater than 1.5. In a case where the crystal orientation index X of the (200) plane of the Sn plating layer 105 is equal to or less than 1.0, corrosion resistance of the chemical treatment steel sheet 10 also deteriorates. The definition of the crystal orientation index X will be described later.

In addition, in the present embodiment, the crystal orientation indexes X other than that of the (100) plane group in the Sn plating layer 105 is less than 1.0. For example, in the Sn plating layer 105, the crystal orientation index X of a (211) plane is less than 1.0. Preferably, the crystal orientation indexes X other than that of the (100) plane group in the Sn plating layer 105 is less than 0.6. As described above, in the Sn plating layer 105, since the crystal orientation indexes X of other crystal orientation planes other than that of the (100) plane group are extremely low, the (100) plane group is preferentially arranged.

<Regarding Crystal Orientation Index X>

The crystal orientation index X is calculated by performing a measurement with an X-ray diffractometer and using the following Expression (2). As the radiation source of the X-ray diffractometer, CuKα rays are used while having the tube current of 100 mA and the tube voltage of 30 kV.

$$X=(A/B)/(C/D) \quad (2)$$

Here,

X: crystal orientation index A: measurement value (unit: cps) of peak intensity of orientation plane to be obtained, B: sum (unit: cps) of measurement values of peak intensity of (200) plane, (101) plane, (211) plane, (301) plane, (112) plane, (400) plane, (321) plane, (420) plane, (411) plane, (312) plane, (501) plane, C: theoretical value (unit: cps) of peak intensity of orientation plane to be obtained by powder X-ray diffraction, D: sum (unit: cps) of theoretical values of peak intensity of (200) plane, (101) plane, (211) plane, (301) plane, (112) plane, (400) plane, (321) plane, (420) plane, (411) plane, (312) plane, (501) plane obtained by powder X-ray diffraction.

The inventors have researched a relationship between I(200)/I(101) which is a ratio obtained by dividing I(200) which is the peak intensity of X-ray diffraction of the (200) plane by I(101) which is the peak intensity of X-ray diffraction of the (101) plane, and the crystal orientation index X obtained by Expression (2). As a result, the inventors have found that even if I(200)/I(101) exceeds 1, the crystal orientation index X does not necessarily exceed 1. For example, there was a case where the crystal orientation index X was 0.668 even when I(200)/I(101) was 2.0.

As the cause of the result described above, the crystal orientation index X is obtained based on the peak intensity ratio relative to the powder X-ray diffraction in a state where the crystal orientation is not arranged. In contrast, the peak intensity ratio obtained by the X-ray diffraction does not appropriately indicate the arranged state of the crystal orientation. For the reason above, in order to appropriately indicate the arranged state of the crystal orientation, the crystal orientation index X obtained by Expression (2) is considered to be appropriate.

In the present embodiment, the Sn plating layer 105 is formed on an upper layer of the steel sheet 103 including α-Fe. However, it is preferable that the surface of the steel sheet 103 on the Sn plating layer 105 side is preferentially arranged to the (100) plane. It is because adhesion between the steel sheet 103 and the Sn plating layer 105 preferentially arranged to the (200) plane is improved, since the surface of the steel sheet 103 on the Sn plating layer 105 side is preferentially arranged to the (100) plane.

[Regarding Chemical Treatment Layer 107]

As illustrated in FIGS. 1A and 1B, the chemical treatment layer 107 is formed on the Sn plating layer 105. The chemical treatment layer 107 is a film layer including a Zr compound containing Zr of 0.50 mg/m$^2$ to 50.0 mg/m$^2$ in terms of the amount of metal Zr per one side surface, and a phosphate compound.

The Zr compound included in the chemical treatment layer 107 according to the present embodiment has a function of improving corrosion resistance, adhesion, and processing adhesion. For example, the Zr compound according to the present embodiment is configured of a plurality of the Zr compounds such as Zr hydroxide and Zr fluoride in addition to Zr oxide and Zr phosphate. In a case where Zr included in the chemical treatment layer 107 is less than 0.50 mg/m$^2$ in terms of metal Zr, the coatability is insufficient and corrosion resistance deteriorates. Thus, it is not preferable. Meanwhile, in a case where Zr included in the chemical treatment layer 107 exceeds 50.0 mg/m$^2$, not only a long period of time is required to form a chemical treatment layer 107 but also uneven adhering is caused. Thus, it is not preferable.

In the chemical treatment layer 107 of the present embodiment, it is preferable that the Zr compound of 5.0 mg/m$^2$ to 25.0 mg/m$^2$ in terms of the amount of metal Zr is included per one side surface.

In addition, the chemical treatment layer 107 further includes one or two or more of phosphate compounds in addition to the Zr compound described above.

The phosphate compound according to the present embodiment has a function of improving corrosion resistance, adhesion, and processing adhesion. Examples of the phosphate compound according to the present embodiment include Fe phosphate, Sn phosphate, and Zr phosphate formed due to reaction between phosphate ion and compounds included in the steel sheet 103, the Sn plating layer 105, and the chemical treatment layer 107. The chemical treatment layer 107 may include one or two or more of the above-described phosphate compounds. The above-described phosphate compounds are excellent in corrosion resistance and adhesion. Therefore, as the amount of the phosphate compound included in the chemical treatment layer 107 increases, corrosion resistance and adhesion of the chemical treatment steel sheet 10 are improved.

The amount of the phosphate compound contained in the chemical treatment layer 107 is not particularly limited. However, it is preferable that the amount thereof is 0.50 mg/m$^2$ to 50.0 mg/m$^2$ in terms of the amount of P. When the chemical treatment layer 107 contains the phosphate compound of the above-described amount, the chemical treatment layer 107 can have favorable corrosion resistance, adhesion, and processing adhesion.

Since the Sn plating layer 105 is preferentially arranged to the (100) plane group, the chemical treatment layer 107 of the present embodiment has excellent corrosion resistance, adhesion, and processing adhesion. As the reason thereof, it is considered that the β-Sn which is preferentially arranged to the (100) plane group in the Sn plating layer 105 is uniformly activated due to the component of a chemical treatment solution such as fluoride ion (surface cleaning effect) and affinity between the Sn plating layer 105 and the chemical treatment layer 107 is improved. That is, it is considered that an activated intermediate layer (not illustrated) is formed between the Sn plating layer 105 and the chemical treatment layer 107. Thus, it is assumed that the activated intermediate layer (not illustrated) is a layer special for the Sn plating layer 105 formed by the manufacturing method of the present invention and is a configuration factor exhibiting an effect the chemical treatment steel sheet 10 of the present invention.

In addition, when the chemical treatment layer 107 is uniformly formed on the Sn plating layer 105 preferentially arranged to the (100) plane group, the chemical treatment steel sheet 10 has favorable external appearance. As the reason thereof, it is considered that the β-Sn in the Sn plating layer 105 and the compounds in the chemical treatment layer 107 are disposed with regularity.

For example, the amount of Zr and the amount of P contained in the chemical treatment layer 107 according to the present embodiment can be measured by a quantitative analysis such as a fluorescent X-ray analysis. In this case, the calibration curve related to the amount of Zr and the calibration curve related to the amount of P are prepared in advance by using a sample having a known amount of Zr and a sample having a known amount of P, and the amount of Zr and the amount of P can be relatively particularized by using the calibration curves.

<Regarding Method of Manufacturing Chemical Treatment Steel Sheet 10>

Figure 2:
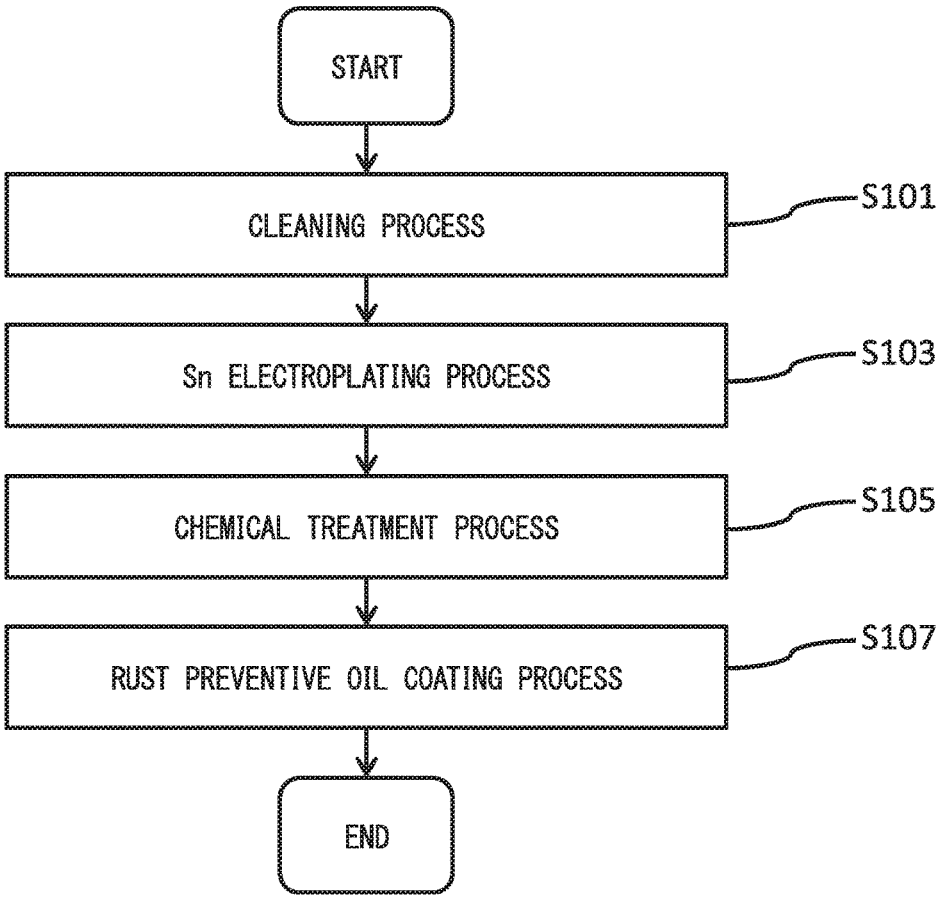
FIG. 2 is a flow chart illustrating an example of a method of manufacturing a chemical treatment steel sheet according to the present embodiment.

Subsequently, a method of manufacturing a chemical treatment steel sheet 10 according to the present embodiment will be described. FIG. 2 is a flow chart illustrating an example of the method of manufacturing a chemical treatment steel sheet 10 according to the present embodiment.

In the method of manufacturing a chemical treatment steel sheet 10 according to the present embodiment, firstly, oil content and scales which have adhered to the surface of the steel sheet 103 which is the base metal are removed (cleaning process). Subsequently, with respect to the surface of the steel sheet 103, Sn electroplating is performed by the method described above, thereby forming a Sn plating layer 105 (Sn electroplating process). Thereafter, the chemical treatment layer 107 is formed by performing electrolytic treatment (chemical treatment process). Then, a surface of the chemical treatment layer 107 is coated with rust preventive oil (rust preventive oil coating process). The treatment is performed in accordance with such a flow, and a chemical treatment steel sheet 10 according to the present embodiment is manufactured.

<Cleaning Process>

In cleaning process, oil content and scales which have adhered to the surface of the steel sheet 103 which is the base metal are removed (Step S101). Examples of cleaning process include alkaline cleaning treatment of removing oil content; pickling treatment of removing a stain of inorganics present in the steel sheet surface, for example, rust, an oxide film (scale), and smut; rinse cleaning treatment of removing a cleaning solution used in the cleaning treatment from the steel sheet surface; and liquid draining treatment of removing a rinse cleaning solution which has adhered during the rinse cleaning treatment from the steel sheet surface.

<Sn Electroplating Process>

In Sn electroplating process of the present embodiment, a Sn plating layer 105 is manufactured by using a Sn electroplating bath such as a phenolsulfonic acid (FERROSTAN) bath and a methanesulfonic acid (RONASTAN) bath (Step S103).

The phenolsulfonic acid bath is a plating bath in which Sn sulfate or Sn is dissolved in phenolsulfonic acid and several types of additives are added. The methanesulfonic acid bath is a plating bath having methanesulfonic acid and stannous methanesulfonate as the main components. An alternative Sn electroplating bath other than those described above can also be used. However, in an alkaline bath, sodium stannate which is tetravalent Sn is used as a supply source of Sn and the productivity deteriorates. Thus, it is not practically preferable. In addition, a halogen bath and a cupric fluoroborate bath are not preferable from the viewpoint of an environmental impact.

It is preferable that the concentration of $Sn^{2+}$ ion in the Sn electroplating bath is 10 g/L to 100 g/L. In a case where the concentration of $Sn^{2+}$ ion is less than 10 g/L, the limiting current density prominently deteriorates and it becomes difficult to perform the Sn electroplating at high current density. As a result, the productivity deteriorates. Thus, it is not preferable. Meanwhile, in a case where the concentration of $Sn^{2+}$ ion exceeds 100 g/L, $Sn^{2+}$ ion becomes excessive and sludge including SnO is generated in the Sn electroplating bath. Thus, it is not preferable.

The Sn electroplating bath may include additives in addition to the above-described components. Examples of the additives which may be included in the Sn electroplating bath include ethoxylated α-naphthol sulfonic acid, ethoxylated α-naphthol, and methoxybenzaldehyde. When the Sn electroplating bath includes the additives, precipitation of the β-Sn plating is favorably performed.

The bath temperature of the Sn electroplating bath is preferably equal to or higher than 40° C. from the viewpoint of electric conductivity and is preferably equal to or lower than 60° C. from the viewpoint of preventing the plating bath from being reduced due to vaporization and the like.

It is preferable that the energization quantity during the Sn electroplating is 170 C/m$^2$ to 37,000 C/m$^2$ from the viewpoint of the Sn content of the Sn plating layer 105 and the productivity.

When the reflow treatment is performed after the Sn electroplating is performed, a gloss is generated on the surface of the Sn plating layer 105 and the mat finishing cannot be performed. Thus, it is not preferable. Therefore, in the present embodiment, the reflow treatment is not performed after the Sn electroplating is performed.

<Regarding Control of Crystal Orientation of Sn Plating Layer 105>

A method of controlling the crystal orientation in the β-Sn plating of the Sn plating layer 105 will be described. In the Sn electroplating, a reactant is carried to an electrode surface by diffusion. However, when the current density reaches a certain degree, all of the carried reactant is consumed due to electrode reaction, and the concentration of the reactant on the electrode surface becomes zero. The current density at this moment is referred to as the limiting current density.

When the Sn electroplating is performed at the current density equal to or greater than the limiting current density, there are cases where powder precipitates are generated on the plating surface or there are cases where dendrite-like plating is formed. Thus, it is not preferable. In addition, when the Sn electroplating is performed at the current density equal to or greater than the limiting current density, a current is consumed for generating hydrogen and the current efficiency deteriorates. Thus, it is not preferable. Meanwhile, when the Sn electroplating is performed, when the current density is lowered, the productivity deteriorates. For the reasons above, industrial Sn electroplating is generally performed at the current density slightly lower than the limiting current density.

The inventors have found that when the Sn electroplating is performed at the current density within a particular range with respect to the limiting current density, the β-Sn is preferentially arranged to the (100) plane group and the steel sheet 103 is favorably coated with the Sn plating layer 105. In addition, the inventors have found that when the Sn electroplating is performed at the current density within a particular range with respect to the limiting current density, the chemical treatment steel sheet 10 has favorable corrosion resistance.

In the present embodiment, the current density in which the current efficiency of the Sn electroplating becomes 90% is set to the limiting current density. In the present embodiment, it is preferable to perform the Sn electroplating at the current density of 10% to 50% with respect to the limiting current density. When the Sn electroplating is performed at the current density of 10% to 50% with respect to the limiting current density, the steel sheet 103 is favorably coated with the Sn plating layer 105 and the β-Sn is preferentially arranged to the (100) plane group.

For example, in a case of the Sn electroplating having the limiting current density of 30 A/dm$^2$, it is preferable to perform the Sn electroplating at the current density of 3 A/dm$^2$ to 15 A/dm$^2$. It is more preferable that the current density is 25% to 40% with respect to the limiting current density.

At the current density equal to or less than 50% of the limiting current density, a β-Sn is preferentially arranged to the (200) plane which is in the (100) plane group of the β-Sn. When the current density exceeds 50% of the limiting current density, the β-Sn is preferentially arranged to the (101) plane group of the β-Sn. Thus, it is not preferable that the current density during the Sn electroplating exceeds 50% of the limiting current density.

Meanwhile, in a case where the current density is less than 10% of the limiting current density, the β-Sn is preferentially arranged to the (100) plane group. However, the frequency of nucleation in plating deteriorates and crystal growth is delayed, thereby resulting in neglected Sn plating. Since Sn is electric potential rarer than Fe and does not have sacrificial corrosion protection ability. Therefore, in the Sn plating steel sheet 101, in a case where the coatability of the steel sheet 103 with the Sn plating layer 105 is insufficient (the steel sheet 103 is exposed), red rust is generated. Therefore, since the coatability of the steel sheet 103 with the Sn plating layer 105 is also important, it is preferable that the current density during the Sn electroplating is equal to or greater than 10% of the limiting current density.

<Predipping Process>

After the Sn electroplating process, before performing the chemical treatment (will be described later), the Sn plating steel sheet 101 may be subjected to predipping. In a case of performing the predipping, before the chemical treatment process, the Sn plating steel sheet 101 is dipped in dilute nitric acid of 0.2% to 1.0% for 2 seconds to 5 seconds, for example. In a different example of the predipping, the Sn plating steel sheet 101 may be dipped in a chemical treatment solution for 1 second to 5 seconds. Through the predipping process, adhered components other than Sn included in the Sn plating bath are removed from the surface of the Sn plating layer 105, and the Surface of the Sn plating layer 105 is activated. Thus, the chemical treatment can be favorably performed.

<Chemical Treatment Process>

In the present embodiment, a chemical treatment layer 107 is formed through the chemical treatment process (Step S105). In the chemical treatment process of the present embodiment, the concentration of Zr ion in the chemical treatment bath is 10 ppm to 10,000 ppm. When the Zr ion in the chemical treatment bath is 10 ppm to 10,000 ppm, the Zr compound content in the chemical treatment layer 107 can be controlled to range from 0.50 $mg/m^2$ to 50.0 $mg/m^2$. In addition, when the Zr ion in the chemical treatment bath is 10 ppm to 10,000 ppm, affinity between the Sn plating layer 105 and the chemical treatment layer 107 is improved and corrosion resistance of the chemical treatment layer 107 is improved. Thus, it is preferable.

In a case where the concentration of Zr ion in the chemical treatment bath is less than 10 ppm, it is insufficient to activate the β-Sn. As a result, corrosion resistance of the chemical treatment steel sheet 10 also deteriorates. Meanwhile, in a case where the concentration of Zr ion in the chemical treatment bath exceeds 10,000 ppm, the β-Sn of the surface of the Sn plating layer 105 is excessively activated. Accordingly, uneven adhering is caused on the surface of the Sn plating layer 105, and corrosion resistance of the chemical treatment steel sheet 10 deteriorates. Thus, it is not preferable. The concentration of Zr ion in the chemical treatment bath is preferably 100 ppm to 10,000 ppm.

In the chemical treatment process of the present embodiment, the concentration of F ion in the chemical treatment bath is 10 ppm to 10,000 ppm. When the concentration of F ion in the chemical treatment bath is 10 ppm to 10,000 ppm, Zr ion and F ion form a complex, and the Zr ion thereby becomes stable. In addition, when the concentration of F ion in the chemical treatment bath is 10 ppm to 10,000 ppm, wettability of the Sn plating layer 105, and affinity between the Sn plating layer 105 and the chemical treatment layer 107 are improved, and corrosion resistance of the chemical treatment layer 107 is improved. Thus, it is preferable.

As a cause of the improvement of affinity between the Sn plating layer 105 and the chemical treatment layer 107, similar to the case of Zr ion, it is considered that since F ion in the chemical treatment bath is 10 ppm to 10,000 ppm, the β-Sn preferentially arranged to the (100) plane group in the Sn plating layer 105 is activated, and the connectivity of the chemical treatment layer 107 with respect to the Sn plating layer 105 is improved. That is, it is considered that an activated intermediate layer (not illustrated) is formed between the Sn plating layer 105 and the chemical treatment layer 107. It is assumed that the activated intermediate layer (not illustrated) is a layer special for the Sn plating layer 105 formed by the manufacturing method of the present invention and is a configuration factor exhibiting an effect the chemical treatment steel sheet 10 of the present invention.

In a case where the concentration of F ion in the chemical treatment bath is less than 10 ppm, Zr ion and F ion do not form a complex, and the Zr ion does not become stable. Thus, it is not preferable. In addition, in a case where the concentration of F ion in the chemical treatment bath is less than 10 ppm, it is insufficient to activate the β-Sn. As a result, corrosion resistance of the chemical treatment steel sheet 10 also deteriorates. Meanwhile, in a case where the concentration of F ion in the chemical treatment bath exceeds 10,000 ppm, Zr ion and F ion excessively form a complex, and reactivity of the Zr ion deteriorates. As a result, the surface of the Sn plating layer 105, that is, hydrolysis reaction with respect to a rise of pH in the cathode interface is delayed, responsiveness during the electrolytic treatment becomes prominently slow, and a long period of electrolysis time is required. Thus, it is not practical. Moreover, in a case where the concentration of F ion in the chemical treatment bath exceeds 10,000 ppm, since a long period of electrolysis time is required as described above, there are cases where the β-Sn is excessively activated and uneven adhering is caused. The concentration of F ion in the chemical treatment bath is preferably 100 ppm to 10,000 ppm.

In the chemical treatment process of the present embodiment, the concentration of phosphate ion in the chemical treatment bath is 10 ppm to 3,000 ppm, and a chemical treatment layer 107 favorably containing the phosphate compound is formed. In a case where the concentration of phosphate ion in the chemical treatment bath is less than 10 ppm, since the chemical treatment layer 107 contains no phosphate compound, corrosion resistance deteriorates. Thus, it is not preferable. In addition, in a case where the concentration of phosphate ion in the chemical treatment bath exceeds 3,000 ppm, there are cases where insolubles (deposits) considered to be caused due to Zr phosphate are formed in the chemical treatment bath and contaminate the chemical treatment bath. Thus, it is not preferable. In addition, in a case where the concentration of phosphate ion in the chemical treatment bath exceeds 3,000 ppm, the phosphate compound contributing to corrosion resistance in the chemical treatment layer 107 is reduced. Thus, it is not preferable. The concentration of phosphate ion in the chemical treatment bath is preferably 100 ppm to 3,000 ppm.

In the chemical treatment process of the present embodiment, nitrate ion in the chemical treatment bath is 100 ppm to 30,000 ppm. Accordingly, the conductivity required for the electrolytic treatment can be maintained, and the chemical treatment layer 107 can be favorably formed. In a case where the concentration of nitrate ion in the chemical treatment bath is less than 100 ppm, since the conductivity is lower than the level required for the electrolytic treatment, the chemical treatment layer 107 is not formed. Thus, it is not preferable. In addition, in a case where the concentration of nitrate ion in the chemical treatment bath exceeds 30,000 ppm, the conductivity excessively increases. Therefore, the chemical treatment layer 107 is formed with a minute current. As a result, local growth or the like is caused in a part of the chemical treatment layer 107, and the chemical treatment layer 107 is not uniformly formed. Accordingly, corrosion resistance of the chemical treatment steel sheet 10 deteriorates. The concentration of nitrate ion in the chemical treatment bath is preferably 1,000 ppm to 30,000 ppm.

In the chemical treatment process of the present embodiment, the temperature of the chemical treatment bath is controlled to 5° C. to 90° C., and Zr ion and F ion favorably form a complex. In a case where the temperature of the chemical treatment bath is less than 5° C., insolubles (deposits) considered to be caused due to Zr phosphate are likely to be formed. In a case where the temperature of the chemical treatment bath exceeds 90° C., Zr ion and F ion do not favorably form a complex, and the chemical treatment layer 107 is not favorably formed. Thus, it is not preferable. The temperature chemical treatment bath is preferably 10° C. to 70° C.

In the chemical treatment process of the present embodiment, pH of the chemical treatment bath is preferably 2.0 to 6.0 and more preferably 3.0 to 4.5. The reason is that when pH of the chemical treatment bath is within the above-described range, impurities are unlikely to be generated and chemical treatment can be favorably performed.

In the chemical treatment process of the present embodiment, an energizing time in the electrolytic treatment is 0.2 seconds to 100 seconds. In a case where the energizing time is less than 0.2 seconds, the adhered amount of the chemical treatment layer 107 becomes small and favorable sulfide stain resistance cannot be obtained. Thus, it is not preferable. In a case where the energizing time exceeds 100 seconds, there are cases where the chemical treatment layer 107 is excessively formed and the chemical treatment layer 107 peels off in the chemical treatment bath. Thus, it is not preferable. In addition, in a case where the energizing time exceeds 100 seconds, the productivity deteriorates. Thus, it is not preferable. The energizing time in the electrolytic treatment is preferably 1 seconds to 50 seconds.

As described above, the crystal orientation of the Sn plating layer 105 according to the present embodiment is preferentially arranged to the (100) plane group. The inventors have found that since the Sn plating layer 105 is preferentially arranged to the (100) plane group, the energizing time in the electrolytic treatment of the chemical treatment process can be shortened, thereby being excellent in productivity. That is, in a case where the crystal orientation of the Sn plating layer 105 is not arranged, the energizing time in the electrolytic treatment of the chemical treatment process is elongated and the productivity deteriorates. Thus, it is not preferable.

As a cause thereof, it is considered that since the crystal orientation of the Sn plating layer 105 is preferentially arranged to the (100) plane group, the surface of the Sn plating layer 105 is uniformly activated, and the chemical treatment layer 107 is likely to be formed. That is, it is considered that an activated intermediate layer (not illustrated) is formed between the Sn plating layer 105 and the chemical treatment layer 107. It is assumed that the activated intermediate layer (not illustrated) is a layer special for the Sn plating layer 105 formed by the manufacturing method of the present invention and is a configuration factor exhibiting an effect the chemical treatment steel sheet 10 of the present invention.

In the chemical treatment process of the present embodiment, the current density is 1.0 A/dm$^2$ to 100 A/dm$^2$.

In a case where the current density is less than 1.0 A/dm$^2$, the adhered amount of the chemical treatment layer 107 becomes small and favorable corrosion resistance cannot be obtained. Thus, it is not preferable. In addition, in a case where the current density is less than 1.0 A/dm$^2$, a long period of the electrolytic treatment time is required and the productivity deteriorates. Thus, it is not preferable. In a case where the current density exceeds 100 A/dm$^2$, since high current density is locally caused, the chemical treatment layer 107 is not uniformly and corrosion resistance of the chemical treatment steel sheet 10 deteriorates. Thus, it is not preferable. The current density is preferably 5.0 A/dm$^2$ to 50 A/dm$^2$.

The current density in the chemical treatment process may be uniform, or the current density may be changed within a range from 1.0 A/dm$^2$ to 100 A/dm$^2$. In a case where the current density is changed in the chemical treatment process, a portion close to the interface between the Sn plating layer 105 and the chemical treatment layer 107 is densely formed, and corrosion resistance and adhesion of coating or the like are improved. Therefore, it is preferable that the current density is gradually increased.

In the chemical treatment process of the present embodiment, it is preferable that a line speed is 50 m/min to 800 m/min. When the line speed is set within the above-described range, Zr ion is stably supplied to the cathode interface, and the chemical treatment layer 107 favorably adheres.

<Rust Preventive Oil Coating Process>

After the chemical treatment layer 107 is formed through the chemical treatment process, a surface of the chemical treatment layer 107 is coated with rust preventive oil (Step S105). Specifically, an electrostatic oiling method can be adopted.

By the above-described manufacturing method, the chemical treatment layer 107 including the Zr compound is formed on the mat finished Sn plating layer 105 which is arranged to a particular plane orientation, and a chemical treatment steel sheet 10 having favorable corrosion resistance is thereby manufactured. Particularly, the chemical treatment steel sheet 10 according to the present embodiment is favorable as a steel sheet for a container in the food field and the beverage can field.

Example

Hereinafter, while illustrating Example, a chemical treatment steel sheet according to the embodiment of the present invention and a manufacturing method of the same will be specifically described. The Example illustrated below is merely an example of a chemical treatment steel sheet according to the embodiment of the present invention and a manufacturing method of the same. The chemical treatment steel sheet according to the embodiment of the present invention and the manufacturing method of the same are not limited to the following example.

(1) Forming Sn Plating Layer

A low carbon steel sheet (C: 0.05 mass %, Si: 0.015 mass %, Mn: 0.4 mass %, P: 0.01 mass %, S: 0.004%) of 200 mm×300 mm×0.18 mm subjected to annealing and temper rolling was used. The above-described low carbon steel sheet was dipped in a sodium hydroxide aqueous solution (5%), and alkaline degreasing was performed by performing cathode electrolytic treatment under the conditions of the temperature 90° C. and the current density of 1 kA/m$^2$. After the alkaline degreasing was performed, the low carbon steel sheet was dipped in a sulfuric acid aqueous solution (10%), and pickling was performed by performing cathode electrolytic treatment under the conditions of the temperature 25° C. and the current density of 1 kA/m$^2$. After the pickling, Sn electroplating was performed by using a circulation cell configured to have a pump, an electrode portion, and a liquid storage portion; and a Sn plating layer was formed on a surface of the low carbon steel sheet. The compositions of the plating baths used in the Sn electroplating are shown in Table 1. The temperature, the limiting current density, the current density, and the energization quantity of the plating bath in each Example are shown in Table 2.

TABLE 1

| Plating bath | Composition of plating bath | |
|---|---|---|
| Bath A | $Sn^{2+}$ 5 g/L (tin sulfate) | Phenolsulfonic acid 15 g/L |
| Bath B | $Sn^{2+}$ 10 g/L (tin sulfate) | Phenolsulfonic acid 15 g/L |
| Bath C | $Sn^{2+}$ 20 g/L (tin sulfate) | Phenolsulfonic acid 15 g/L |
| Bath D | $Sn^{2+}$ 30 g/L (tin sulfate) | Phenolsulfonic acid 15 g/L |
| Bath E | $Sn^{2+}$ 40 g/L (tin sulfate) | Phenolsulfonic acid 15 g/L |
| Bath F | $Sn^{2+}$ 100 g/L (tin sulfate) | Phenolsulfonic acid 15 g/L |
| Bath G | $Sn^{2+}$ 120 g/L (tin sulfate) | Phenolsulfonic acid 15 g/L |
| Bath H | $Sn^{2+}$ 30 g/L (stannous methanesulfonate) | Methanesulfonic acid 120 g/L |

TABLE 2

| Condition of Sn electroplating | Plating bath | Bath temperature (° C.) | Limiting current density (A/dm$^2$) | Current density (A/dm$^2$) | (Current density)/(Limiting current density) | Energization quantity (C/m$^2$) | Sn content (g/m$^2$) | Orientation index of (200) plane | IEV (mA/dm$^2$) | Remarks |
|---|---|---|---|---|---|---|---|---|---|---|
| Cond. 1 | Bath A | 45 | 13 | 3.9 | 0.30 | 4200 | 2.3 | 1.8 | 12 | Example |
| Cond. 2 | Bath B | 45 | 25 | 7.5 | 0.30 | 4300 | 2.4 | 1.9 | 10 | Example |
| Cond. 3 | Bath C | 45 | 50 | 15 | 0.30 | 4500 | 2.5 | 1.8 | 9 | Example |
| Cond. 4 | Bath D | 45 | 75 | 22.5 | 0.30 | 4500 | 2.5 | 1.8 | 9 | Example |
| Cond. 5 | Bath E | 45 | 100 | 30 | 0.30 | 4500 | 2.5 | 1.8 | 8 | Example |
| Cond. 6 | Bath F | 45 | 250 | 75 | 0.30 | 4500 | 2.5 | 1.7 | 8 | Example |
| Cond. 7 | Bath G | 45 | 300 | 90 | 0.30 | 4500 | 2.5 | 1.8 | 7 | Example |
| Cond. 8 | Bath H | 45 | 75 | 22.5 | 0.30 | 4500 | 2.5 | 1.8 | 6 | Example |
| Cond. 9 | Bath D | 35 | 50 | 15 | 0.30 | 4500 | 2.5 | 1.8 | 10 | Example |
| Cond. 10 | Bath D | 40 | 70 | 21 | 0.30 | 4500 | 2.5 | 1.9 | 9 | Example |
| Cond. 11 | Bath D | 50 | 80 | 24 | 0.30 | 4500 | 2.5 | 1.9 | 9 | Example |
| Cond. 12 | Bath D | 60 | 85 | 25.5 | 0.30 | 4500 | 2.5 | 1.8 | 8 | Example |
| Cond. 13 | Bath D | 65 | 90 | 27 | 0.30 | 4515 | 2.5 | 1.7 | 8 | Example |
| Cond. 14 | Bath D | 50 | 80 | 24 | 0.30 | 165 | 0.08 | 2.0 | 20 | Comparative Example |
| Cond. 15 | Bath D | 50 | 80 | 24 | 0.30 | 180 | 0.1 | 1.9 | 15 | Example |
| Cond. 16 | Bath D | 50 | 80 | 24 | 0.30 | 1800 | 1 | 1.9 | 12 | Example |
| Cond. 17 | Bath D | 50 | 80 | 24 | 0.30 | 3600 | 2 | 1.8 | 10 | Example |
| Cond. 18 | Bath D | 50 | 80 | 24 | 0.30 | 4500 | 2.5 | 1.8 | 8 | Example |
| Cond. 19 | Bath D | 50 | 80 | 24 | 0.30 | 10500 | 6 | 1.8 | 7 | Example |
| Cond. 20 | Bath D | 50 | 80 | 24 | 0.30 | 14000 | 8 | 1.7 | 6 | Example |
| Cond. 21 | Bath D | 50 | 80 | 24 | 0.30 | 18000 | 10 | 1.6 | 5 | Example |
| Cond. 22 | Bath D | 50 | 80 | 24 | 0.30 | 27000 | 15 | 1.6 | 4 | Example |
| Cond. 23 | Bath D | 50 | 80 | 24 | 0.30 | 36000 | 20 | 1.6 | 4 | Example |
| Cond. 24 | Bath D | 50 | 80 | 24 | 0.30 | 45000 | 25 | 1.6 | 4 | Comparative Example |
| Cond. 25 | Bath D | 50 | 80 | 5 | 0.06 | 4500 | 2.5 | 2.5 | 45 | Comparative Example |
| Cond. 26 | Bath D | 50 | 80 | 7 | 0.09 | 4500 | 2.5 | 2.1 | 25 | Comparative Example |
| Cond. 27 | Bath D | 50 | 80 | 8 | 0.10 | 4500 | 2.5 | 2.0 | 14 | Example |
| Cond. 28 | Bath D | 50 | 80 | 20 | 0.25 | 4500 | 2.5 | 1.6 | 13 | Example |
| Cond. 29 | Bath D | 50 | 80 | 30 | 0.38 | 4500 | 2.5 | 1.4 | 11 | Example |
| Cond. 30 | Bath D | 50 | 80 | 40 | 0.50 | 4500 | 2.5 | 1.1 | 8 | Example |
| Cond. 31 | Bath D | 50 | 80 | 45 | 0.56 | 4500 | 2.5 | 0.9 | 8 | Comparative Example |

The flow rate of the plating bath inside the circulation cell was controlled at a pumping rate of 5 m/s. The temperature of the plating bath was measured by a thermostat provided in the liquid storage portion. The current density was controlled by using a DC power source. The plating adhered amount was adjusted based on the energization quantity, that is, the product obtained by multiplying the current density and the electrolysis time together. As an antipode, an insoluble anode (platinum-plating titanium) was used.

(2) Measuring Amount of Metal Sn

The amount of metal Sn included in the Sn plating layer was measured by the fluorescent X-ray method described above. The result is shown in Table 2 together with the conditions of the Sn electroplating.

(3) Measuring Crystal Orientation Index

A Sn electroplating steel sheet (no chemical treatment layer was formed) was subjected to X-ray diffraction by using an X-ray diffractometer, and the peak intensity of each orientation plane was measured. The X-ray diffraction was performed by using CuKα rays as the radiation source, under the conditions of the tube current of 100 mA and the tube voltage of 30 kV. The crystal orientation index of the (200) plane was calculated by using the following Expression (3) using the measured result.

$$X=(A/B)/(C/D) \quad (3)$$

Here,

X: crystal orientation index A: measurement value (unit: cps) of peak intensity of orientation plane to be obtained, B: sum (unit: cps) of measurement values of peak intensity of (200) plane, (101) plane, (211) plane, (301) plane, (112) plane, (400) plane, (321) plane, (420) plane, (411) plane, (312) plane, (501) plane, C: theoretical value (unit: cps) of peak intensity of orientation plane to be obtained by powder X-ray diffraction, D: sum (unit: cps) of theoretical values of peak intensity of (200) plane, (101) plane, (211) plane, (301) plane, (112) plane, (400) plane, (321) plane, (420) plane, (411) plane, (312) plane, (501) plane obtained by powder X-ray diffraction.

In a case where the crystal orientation index of the (200) plane was equal to or greater than 1.0, it was determined that the Sn-plating layer was orientated toward the (200) plane. Together with the conditions of the Sn electroplating, the result of the crystal orientation index is shown in Table 2.

(4) Measuring IEV

The iron exposure value (IEV) of the obtained Sn-plating steel sheet was measured. First, the Sn plating steel sheet was subjected to anodic polarization to electric potential (1.2 vs. SCE) in which Sn was passivated, in a test solution which contains sodium carbonate of 21 g/L, sodium hydrogen carbonate of 17 g/L, and sodium chloride of 0.3 g/L, of which pH was 10, and of which the temperature was 25° C. The current density after three minutes from the anodic polarization was measured, and the obtained current density was taken as the IEV. In a case where the IEV was equal to or less than 15 mA/dm$^2$, it was determined that the coverage of β-Sn was favorable. The measurement result of the IEV is shown in Table 2.

(5) Forming Chemical Treatment Layer

A chemical treatment layer including a Zr compound and a phosphate compound was formed on a surface of the above-described Sn plating steel sheet under the conditions shown in Tables 3 and 4.

TABLE 3

| Condition of chemical treatment | Concentration of Zr ion (ppm) | Concentration of F ion (ppm) | Concentration of phosphate ion (ppm) | Concentration of nitrate ion (ppm) |
|---|---|---|---|---|
| Cond. 1 | 10 | 1000 | 1000 | 10000 |
| Cond. 2 | 100 | 1000 | 1000 | 10000 |
| Cond. 3 | 1000 | 1000 | 1000 | 10000 |
| Cond. 4 | 10000 | 1000 | 1000 | 10000 |
| Cond. 5 | 8 | 1000 | 1000 | 10000 |
| Cond. 6 | 11000 | 1000 | 1000 | 10000 |
| Cond. 7 | 1000 | 10 | 1000 | 10000 |
| Cond. 8 | 1000 | 100 | 1000 | 10000 |
| Cond. 9 | 1000 | 10000 | 1000 | 10000 |
| Cond. 10 | 1000 | 8 | 1000 | 10000 |
| Cond. 11 | 1000 | 11000 | 1000 | 10000 |
| Cond. 12 | 1000 | 1000 | 10 | 10000 |
| Cond. 13 | 1000 | 1000 | 100 | 10000 |
| Cond. 14 | 1000 | 1000 | 3000 | 10000 |
| Cond. 15 | 1000 | 1000 | 8 | 10000 |
| Cond. 16 | 1000 | 1000 | 3200 | 10000 |
| Cond. 17 | 1000 | 1000 | 1000 | 100 |
| Cond. 18 | 1000 | 1000 | 1000 | 1000 |
| Cond. 19 | 1000 | 1000 | 1000 | 30000 |
| Cond. 20 | 1000 | 1000 | 1000 | 90 |
| Cond. 21 | 1000 | 1000 | 1000 | 32000 |
| Cond. 22 | 1000 | 1000 | 1000 | 10000 |
| Cond. 23 | 1000 | 1000 | 1000 | 10000 |
| Cond. 24 | 1000 | 1000 | 1000 | 10000 |
| Cond. 25 | 1000 | 1000 | 1000 | 10000 |
| Cond. 26 | 1000 | 1000 | 1000 | 10000 |
| Cond. 27 | 1000 | 1000 | 1000 | 10000 |
| Cond. 28 | 1000 | 1000 | 1000 | 10000 |
| Cond. 29 | 1000 | 1000 | 1000 | 10000 |
| Cond. 30 | 1000 | 1000 | 1000 | 10000 |
| Cond. 31 | 1000 | 1000 | 1000 | 10000 |
| Cond. 32 | 1000 | 1000 | 1000 | 10000 |
| Cond. 33 | 1000 | 1000 | 1000 | 10000 |
| Cond. 34 | 1000 | 1000 | 1000 | 10000 |
| Cond. 35 | 1000 | 1000 | 1000 | 10000 |
| Cond. 36 | 1000 | 1000 | 1000 | 10000 |
| Cond. 37 | 1000 | 1000 | 1000 | 10000 |
| Cond. 38 | 1000 | 1000 | 1000 | 10000 |
| Cond. 39 | 1000 | 1000 | 1000 | 10000 |
| Cond. 40 | 1000 | 1000 | 1000 | 10000 |
| Cond. 41 | 1000 | 1000 | 1000 | 10000 |
| Cond. 42 | 1000 | 1000 | 1000 | 10000 |

TABLE 4

| Condition of chemical treatment | Bath temperature (° C.) | Current density (A/dm$^2$) | Electrolysis time (sec) | Zr content (mg/m$^2$) | P content (mg/m$^2$) | Remarks |
|---|---|---|---|---|---|---|
| Cond. 1 | 30 | 20 | 20 | 0.5 | 6.8 | |
| Cond. 2 | 30 | 20 | 20 | 4.8 | 7.2 | |
| Cond. 3 | 30 | 20 | 20 | 10.3 | 8.1 | |
| Cond. 4 | 30 | 20 | 20 | 47 | 8.3 | |
| Cond. 5 | 30 | 20 | 20 | 0.4 | 5.4 | |
| Cond. 6 | 30 | 20 | 20 | 52 | 4 | |
| Cond. 7 | 30 | 20 | 20 | 5.1 | 3.8 | |
| Cond. 8 | 30 | 20 | 20 | 10.8 | 8.1 | |
| Cond. 9 | 30 | 20 | 20 | 43 | 32 | |
| Cond. 10 | 30 | 20 | 20 | 0.4 | 0.4 | |
| Cond. 11 | 30 | 20 | 20 | 53 | 40 | Unevenness in chemical treatment layer |
| Cond. 12 | 30 | 20 | 20 | 9.8 | 0.8 | |
| Cond. 13 | 30 | 20 | 20 | 10.4 | 2.4 | |
| Cond. 14 | 30 | 20 | 20 | 11.2 | 11.2 | |
| Cond. 15 | 30 | 20 | 20 | 6.8 | Less than 0.1 | |
| Cond. 16 | 30 | 20 | 20 | 12 | 12 | Deposits in chemical treatment bath |
| Cond. 17 | 30 | 20 | 20 | 0.8 | 0.9 | |
| Cond. 18 | 30 | 20 | 20 | 4.4 | 3.3 | |
| Cond. 19 | 30 | 20 | 20 | 13 | 9.8 | |
| Cond. 20 | 30 | 20 | 20 | 0.4 | 0.2 | |
| Cond. 21 | 30 | 20 | 20 | 60 | 45 | |

TABLE 4-continued

| Condition of chemical treatment | Bath temperature (° C.) | Current density (A/dm$^2$) | Electrolysis time (sec) | Zr content (mg/m$^2$) | P content (mg/m$^2$) | Remarks |
|---|---|---|---|---|---|---|
| Cond. 22 | 3 | 20 | 20 | 0.4 | 0.3 | Deposits in chemical treatment bath |
| Cond. 23 | 5 | 20 | 20 | 2.1 | 1.5 | |
| Cond. 24 | 10 | 20 | 20 | 3.8 | 3 | |
| Cond. 25 | 50 | 20 | 20 | 10.8 | 8.3 | |
| Cond. 26 | 70 | 20 | 20 | 4.9 | 3.8 | |
| Cond. 27 | 90 | 20 | 20 | 2.9 | 2.2 | |
| Cond. 28 | 95 | 20 | 20 | 0.3 | 0.4 | Failed to form chemical treatment layer |
| Cond. 29 | 30 | 0.8 | 20 | 0.4 | 0.5 | |
| Cond. 30 | 30 | 1 | 20 | 0.5 | 0.4 | |
| Cond. 31 | 30 | 5 | 20 | 2.6 | 2 | |
| Cond. 32 | 30 | 10 | 20 | 5.2 | 3.9 | |
| Cond. 33 | 30 | 50 | 20 | 27 | 20 | |
| Cond. 34 | 30 | 100 | 20 | 49 | 37 | |
| Cond. 35 | 30 | 110 | 20 | 52 | 39 | Unevenness in chemical treatment layer |
| Cond. 36 | 30 | 20 | 0.1 | 0.4 | 0.3 | |
| Cond. 37 | 30 | 20 | 0.2 | 0.5 | 0.4 | |
| Cond. 38 | 30 | 20 | 1 | 0.9 | 0.7 | |
| Cond. 39 | 30 | 20 | 10 | 5.4 | 4 | |
| Cond. 40 | 30 | 20 | 50 | 25 | 18.9 | |
| Cond. 41 | 30 | 20 | 100 | 49 | 37 | |
| Cond. 42 | 30 | 20 | 110 | 55 | 41 | Peeling of chemical treatment layer |

(6) Measuring Amount of Zr and Amount of P

The amount of metal Zr and the amount of P included in the chemical treatment layer was measured by the fluorescent X-ray method described above. The measured amount of metal Zr and the measured amount of P are shown in Table 4.

(7) Evaluation of Yellowing Resistance

The above-described chemical treatment steel sheet was used as a test piece. The test piece was installed for 1,000 hours under a constant temperature/humidity environment of 40° C. and 80% RH, and the degree ΔE of a color change of the test piece before and after the test was measured by using a color-difference meter (manufactured by KONICA MINOLTA, CM-2600d) and was calculated, thereby evaluating yellowing resistance. In a case where the ΔE was equal to or less than 2.0, the yellowing resistance was evaluated to be favorable. Tables 5 and 6 disclose the evaluation result of the yellowing resistance.

In Tables 5 and 6, in a case where the result of the evaluation of the yellowing resistance indicates "-", the sign denotes a case where yellowing has not proceeded uniformly, and even though the ΔE was measured by the above-described method, unevenness was excessively significant such that the evaluation could not be properly performed.

(8) Evaluation of Sulfide Stain Resistance

An aqueous solution in which a sodium thiosulfate aqueous solution of 0.1% and sulfuric acid of 0.1 N were mixed by the volume fraction of 1:2 was used as a test solution of sulfide stain resistance. The chemical treatment steel sheet having the above-described chemical treatment layer formed thereon was cut out to be φ35 mm, was put on the mouth of a heat resistant bottle having the test solution of sulfide stain resistance therein, and was fixed. Thereafter, heat treatment was performed at 121° C. for 60 minutes. The sulfide stain resistance was evaluated based on the ratio of the corroded area with respect to the area where the test solution of sulfide stain resistance was in contact with the chemical treatment steel sheet (the area of the mouth of the heat resistant bottle), and an evaluation point was granted from the range of 1 to 5 points based on the following criteria. In a case of 3 points or higher, the product can be practically used as a steel sheet for a container. Therefore, 3 points or higher was accepted. Tables 5 and 6 disclose the evaluation result of the sulfide stain resistance.

<Evaluation Criteria of Sulfide Stain Resistance>

5 points: less than 20% to 0%
4 points: less than 40% to 20%
3 points: less than 60% to 40%
2 points: less than 80% to 60%
1 point: less than 100% to 80%

TABLE 5

| Level | Condition of Sn electro-plating | Condition of chemical treatment | Yellowing resistance ΔE | Sulfide stain resistance | Remarks |
|---|---|---|---|---|---|
| Level 1 | Condition 1 | Condition 3 | 1.3 | 3 | Example |
| Level 2 | Condition 2 | Condition 3 | 1.1 | 3 | Example |
| Level 3 | Condition 3 | Condition 3 | 1 | 3 | Example |
| Level 4 | Condition 4 | Condition 3 | 0.9 | 3 | Example |
| Level 5 | Condition 5 | Condition 3 | 0.9 | 3 | Example |
| Level 6 | Condition 6 | Condition 3 | 0.8 | 3 | Example |
| Level 7 | Condition 7 | Condition 3 | 0.8 | 3 | Example |
| Level 8 | Condition 8 | Condition 3 | 0.8 | 3 | Example |
| Level 9 | Condition 9 | Condition 3 | 0.9 | 3 | Example |
| Level 10 | Condition 10 | Condition 3 | 1.1 | 3 | Example |
| Level 11 | Condition 11 | Condition 3 | 0.8 | 3 | Example |
| Level 12 | Condition 12 | Condition 3 | 0.7 | 3 | Example |
| Level 13 | Condition 13 | Condition 3 | 1 | 3 | Example |
| Level 14 | Condition 14 | Condition 3 | 4.6 | 2 | Comparative Example |
| Level 15 | Condition 15 | Condition 3 | 1.9 | 3 | Example |
| Level 16 | Condition 16 | Condition 3 | 1.4 | 3 | Example |
| Level 17 | Condition 17 | Condition 3 | 1.2 | 3 | Example |
| Level 18 | Condition 18 | Condition 3 | 0.9 | 3 | Example |
| Level 19 | Condition 19 | Condition 3 | 0.8 | 3 | Example |
| Level 20 | Condition 20 | Condition 3 | 0.9 | 3 | Example |
| Level 21 | Condition 21 | Condition 3 | 0.7 | 3 | Example |
| Level 22 | Condition 22 | Condition 3 | 0.8 | 3 | Example |
| Level 23 | Condition 23 | Condition 3 | 0.8 | 3 | Example |

TABLE 5-continued

| Level | Condition of Sn electro-plating | Condition of chemical treatment | Yellow-ing resis-tance ΔE | Sulfide stain resis-tance | Remarks |
|---|---|---|---|---|---|
| Level 24 | Condition 24 | Condition 3 | 0.8 | 3 | Reference Example |
| Level 25 | Condition 25 | Condition 3 | 4.8 | 1 | Comparative Example |
| Level 26 | Condition 26 | Condition 3 | 3.9 | 2 | Comparative Example |
| Level 27 | Condition 27 | Condition 3 | 1.4 | 3 | Example |
| Level 28 | Condition 28 | Condition 3 | 0.9 | 3 | Example |
| Level 29 | Condition 29 | Condition 3 | 0.7 | 3 | Example |
| Level 30 | Condition 30 | Condition 3 | 1.1 | 3 | Example |
| Level 31 | Condition 31 | Condition 3 | 2.2 | 1 | Comparative Example |
| Level 32 | Condition 18 | Condition 1 | 1.8 | 3 | Example |
| Level 33 | Condition 18 | Condition 2 | 1.5 | 3 | Example |
| Level 34 | Condition 18 | Condition 3 | 1.2 | 4 | Example |
| Level 35 | Condition 18 | Condition 4 | 0.8 | 5 | Example |
| Level 36 | Condition 18 | Condition 5 | 3.5 | 2 | Comparative Example |
| Level 37 | Condition 18 | Condition 6 | 4.1 | 2 | Comparative Example |
| Level 38 | Condition 18 | Condition 7 | 1.1 | 3 | Example |
| Level 39 | Condition 18 | Condition 8 | 1.3 | 4 | Example |
| Level 40 | Condition 18 | Condition 9 | 0.9 | 5 | Example |

TABLE 6

| Level | Condition of Sn electro-plating | Condition of chemical treatment | Yellow-ing resis-tance ΔE | Sulfide stain resis-tance | Remarks |
|---|---|---|---|---|---|
| Level 41 | Condition 18 | Condition 10 | 4.5 | 1 | Comparative Example |
| Level 42 | Condition 18 | Condition 11 | — | 1 (caused uneven pattern) | Comparative Example |
| Level 43 | Condition 18 | Condition 12 | 0.9 | 3 | Example |
| Level 44 | Condition 18 | Condition 13 | 1.1 | 4 | Example |
| Level 45 | Condition 18 | Condition 14 | 1 | 4 | Example |
| Level 46 | Condition 18 | Condition 15 | 2.2 | 2 | Comparative Example |
| Level 47 | Condition 18 | Condition 16 | — | 1 (caused much depos-its) | Comparative Example |
| Level 48 | Condition 18 | Condition 17 | 1.6 | 3 | Example |
| Level 49 | Condition 18 | Condition 18 | 1.3 | 3 | Example |
| Level 50 | Condition 18 | Condition 19 | 1 | 3 | Example |
| Level 51 | Condition 18 | Condition 20 | 2.8 | 2 | Comparative Example |
| Level 52 | Condition 18 | Condition 21 | 3.1 | 2 | Comparative Example |
| Level 53 | Condition 18 | Condition 22 | — | 1 (caused much depos-its) | Comparative Example |
| Level 54 | Condition 18 | Condition 23 | 1.5 | 3 | Example |
| Level 55 | Condition 18 | Condition 24 | 1.3 | 3 | Example |
| Level 56 | Condition 18 | Condition 25 | 1.1 | 4 | Example |
| Level 57 | Condition 18 | Condition 26 | 1.2 | 3 | Example |
| Level 58 | Condition 18 | Condition 27 | 1.4 | 3 | Example |
| Level 59 | Condition 18 | Condition 28 | 5.1 | 1 | Comparative Example |
| Level 60 | Condition 18 | Condition 29 | 5.3 | 1 | Comparative Example |
| Level 61 | Condition 18 | Condition 30 | 1.8 | 3 | Example |
| Level 62 | Condition 18 | Condition 31 | 1.6 | 3 | Example |

TABLE 6-continued

| Level | Condition of Sn electro-plating | Condition of chemical treatment | Yellow-ing resis-tance ΔE | Sulfide stain resis-tance | Remarks |
|---|---|---|---|---|---|
| Level 63 | Condition 18 | Condition 32 | 1.3 | 3 | Example |
| Level 64 | Condition 18 | Condition 33 | 0.9 | 4 | Example |
| Level 65 | Condition 18 | Condition 34 | 0.7 | 3 | Example |
| Level 66 | Condition 18 | Condition 35 | — | 1 (caused uneven pattern) | Comparative Example |
| Level 67 | Condition 18 | Condition 36 | 4.8 | 2 | Comparative Example |
| Level 68 | Condition 18 | Condition 37 | 1.7 | 3 | Example |
| Level 69 | Condition 18 | Condition 38 | 1.4 | 3 | Example |
| Level 70 | Condition 18 | Condition 39 | 1.2 | 3 | Example |
| Level 71 | Condition 18 | Condition 40 | 0.9 | 4 | Example |
| Level 72 | Condition 18 | Condition 41 | 0.6 | 3 | Example |
| Level 73 | Condition 18 | Condition 42 | — | 2 (caused peeling) | Comparative Example |

According the evaluation result described above, it is clear that the chemical treatment steel sheet of the present embodiment has excellent corrosion resistance.

Hereinbefore, with reference to the accompanying drawings, the favorable embodiment of the present invention has been described in detail. However, the present invention is not limited to the example. It is clear that those having general knowledge related to the field of the technology in which the present invention belongs can conceive various types of modification examples and revision examples within the scope of the technical ideas disclosed in claims. Naturally, it is understood that the modification examples and the revision examples also belong to the technical scope of the present invention.

INDUSTRIAL APPLICABILITY

According to the embodiment described above, it is possible to provide a Sn plating steel sheet and a chemical treatment steel sheet having excellent corrosion resistance, and a method of manufacturing the same.

BRIEF DESCRIPTION OF THE REFERENCE SYMBOLS

10 CHEMICAL TREATMENT STEEL SHEET
101 Sn PLATING STEEL SHEET
103 STEEL SHEET
105 Sn PLATING LAYER
107 CHEMICAL TREATMENT LAYER

The invention claimed is:

1. A chemical treatment steel sheet comprising:

a steel sheet;

a Sn plating layer that is matte finished as defined in JIS G3303: 2008 and is formed of a β-Sn on the steel sheet, wherein when a crystal orientation index of a (200) plane of the Sn plating layer is defined as X which is expressed by the following Expression (1), the X is equal to or greater than 1.0

$$X=(A/B)/(C/D) \quad (1)$$

here,

X: crystal orientation index,

A: each measurement value (unit: cps) of a peak intensity of (200) plane, (101) plane, (211) plane, (301) plane, (112) plane, (400) plane, (321) plane, (420) plane, (411) plane, (312) plane, (501) plane, B: sum (unit: cps) of measurement values of peak intensity of (200) plane, (101) plane, (211) plane, (301) plane, (112) plane, (400) plane, (321) plane, (420) plane, (411) plane, (312) plane, (501) plane, C: each theoretical value (unit: cps) of peak intensity of (200) plane, (101) plane, (211) plane, (301) plane, (112) plane, (400) plane, (321) plane, (420) plane, (411) plane, (312) plane, (501) plane by powder X-ray diffraction, D: sum (unit: cps) of theoretical values of peak intensity of (200) plane, (101) plane, (211) plane, (301) plane, (112) plane, (400) plane, (321) plane, (420) plane, (411) plane, (312) plane, (501) plane obtained by powder X-ray diffraction; and a chemical treatment layer that is provided as an upper layer of the Sn plating layer, wherein the Sn plating layer contains the β-Sn of 0.10 $g/m^2$ to 20.0 $g/m^2$ in terms of an amount of metal Sn, wherein a crystal orientation index of a (100) plane group of the Sn plating layer is higher than crystal orientation indexes of other crystal orientation planes, and wherein the chemical treatment layer includes a Zr compound containing Zr of 0.50 $mg/m^2$ to 50.0 $mg/m^2$ in terms of an amount of metal Zr, and a phosphate compound.

2. A method of manufacturing the chemical treatment steel sheet according to claim 1, comprising:

a Sn electroplating process of forming a Sn plating layer containing a β-Sn on a steel sheet by an electroplating, wherein a current density is 10% to 50% with respect to a limiting current density; and a chemical treatment process of performing an electrolytic treatment on the steel sheet, on which the Sn plating layer is formed, to form a chemical treatment layer on the Sn plating layer in a chemical treatment bath.

3. The method of manufacturing a chemical treatment steel sheet according to claim 2, wherein in the chemical treatment process, performing the electrolytic treatment on the steel sheet, on which the Sn plating layer is formed, in the chemical treatment bath including Zr ion of 10 ppm to 10,000 ppm, F ion of 10 ppm to 10,000 ppm, phosphate ion of 10 ppm to 3,000 ppm, and nitrate ion of 100 ppm to 30,000 ppm at a temperature of 5° C. to 90° C. under conditions of current density of 1.0 $A/dm^2$ to 100 $A/dm^2$ and an electrolytic treatment time of 0.2 seconds to 100 seconds.

4. A Sn plating steel sheet comprising:

a steel sheet; and a Sn plating layer that is matte finished as defined in JIS G3303: 2008 and is formed of a β-Sn on the steel sheet, wherein when a crystal orientation index of a (200) plane of the Sn plating layer is defined as X which is expressed by the following Expression (1), the X is equal to or greater than 1.0

$$X=(A/B)/(C/D) \quad (1)$$

here,

X: crystal orientation index,

A: each measurement value (unit: cps) of a peak intensity of (200) plane, (101) plane, (211) plane, (301) plane, (112) plane, (400) plane, (321) plane, (420) plane, (411) plane, (312) plane, (501) plane, B: sum (unit: cps) of measurement values of peak intensity of (200) plane, (101) plane, (211) plane, (301) plane, (112) plane, (400) plane, (321) plane, (420) plane, (411) plane, (312) plane, (501) plane, C: each theoretical value (unit: cps) of peak intensity of (200) plane, (101) plane, (211) plane, (301) plane, (112) plane, (400) plane, (321) plane, (420) plane, (411) plane, (312) plane, (501) plane by powder X-ray diffraction, D: sum (unit: cps) of theoretical values of peak intensity of (200) plane, (101) plane, (211) plane, (301) plane, (112) plane, (400) plane, (321) plane, (420) plane, (411) plane, (312) plane, (501) plane obtained by powder X-ray diffraction;

wherein the Sn plating layer contains the β-Sn of 0.10 $g/m^2$ to 20.0 $g/m^2$ in terms of an amount of metal Sn, and wherein a crystal orientation index of a (100) plane group of the Sn plating layer is higher than crystal orientation indexes of other crystal orientation planes.

5. A method of manufacturing the Sn plating steel sheet according to claim 4, comprising:

a Sn electroplating process of forming a Sn plating layer containing a β-Sn on a steel sheet by electroplating, wherein a current density is 10% to 50% with respect to a limiting current density.

* * * * *